US010233937B1

(12) United States Patent
Volk

(10) Patent No.: US 10,233,937 B1
(45) Date of Patent: Mar. 19, 2019

(54) SUBMERSIBLE PUMP THRUST SURFACE ARRANGEMENT

(71) Applicant: Franklin Electric Co., Inc., Fort Wayne, IN (US)

(72) Inventor: James J. Volk, Fort Wayne, IN (US)

(73) Assignee: Franklin Electric Co., Inc., Fort Wayne, IN (US)

( * ) Notice: Subject to any disclaimer, the term of this patent is extended or adjusted under 35 U.S.C. 154(b) by 299 days.

(21) Appl. No.: 15/051,392

(22) Filed: Feb. 23, 2016

Related U.S. Application Data

(60) Provisional application No. 62/120,013, filed on Feb. 24, 2015.

(51) Int. Cl.

| | |
|---|---|
| ***F04D 1/06*** | (2006.01) |
| ***B21D 22/02*** | (2006.01) |
| ***B21D 51/16*** | (2006.01) |
| ***F04D 29/08*** | (2006.01) |
| ***F04D 29/22*** | (2006.01) |
| ***F04D 29/42*** | (2006.01) |
| ***F04D 29/44*** | (2006.01) |

(Continued)

(52) U.S. Cl.
CPC ..... *F04D 29/086* (2013.01); *B21D 22/02* (2013.01); *B21D 51/16* (2013.01); *F04D 1/06* (2013.01);

(Continued)

(58) Field of Classification Search
CPC ..... F04D 29/08; F04D 29/086; F04D 29/165; F04D 29/167; F04D 29/406;

(Continued)

(56) References Cited

U.S. PATENT DOCUMENTS 3,730,641 A * 5/1973 Gordon ..... F04D 1/06 415/199.3
3,807,894 A 4/1974 O'Rourke
(Continued)

FOREIGN PATENT DOCUMENTS

JP 2001041193 2/2001
WO 2011097341 8/2011
WO WO 2015008224 A9 * 12/2015 ..... F04D 1/063

OTHER PUBLICATIONS

Stairs brochure, SP submersible pumps, Jul. 2015.
Stairs brochure, SLK immersible pumps, Jul. 2015.
Goulds Brochure, eSV pumps, Jan. 2016.

*Primary Examiner* — Richard A Edgar
*Assistant Examiner* — Elton K Wong
(74) *Attorney, Agent, or Firm* — Faegre Baker Daniels LLP

(57) ABSTRACT

A multistage submersible pump includes interstage sealing operable to inhibit upstream fluid recirculation, while also having a reduced or eliminated wear-in procedure. A wear-in bearing surface erodes during an initial, wear-in procedure of the pump, and a low-friction service bearing surface slowly engages as the wear-in procedure is completed. Both the wear-in and service bearing surfaces are integrated into a single, stamped stainless steel housing component, such that axial tolerance between the two surfaces is tightly controllable. The pump impeller provides corresponding wear-in and service bearing elements formed as part of a single monolithic component, thereby also offering tight axial tolerance control for the bearing elements which engage the bearing surfaces of the cup component. During initial operation of the pump, only a small portion of the wear-in bearing element is required to wear down to allow engagement of the service bearing element, thereby minimizing the required time to achieve optimal pump performance and enabling the use of a wide range of materials for the pump impeller.

30 Claims, 5 Drawing Sheets

FIG. 6

(51) Int. Cl.
*F04D 29/62* (2006.01)
*F04D 29/046* (2006.01)

(52) U.S. Cl.
CPC ..... *F04D 29/046* (2013.01); *F04D 29/22* (2013.01); *F04D 29/4266* (2013.01); *F04D 29/445* (2013.01); *F04D 29/628* (2013.01)

(58) Field of Classification Search
CPC .. F04D 29/426; F04D 29/4266; F04D 29/445; F04D 29/628; F04D 1/06; F04D 1/063; F04D 1/066; F04D 17/12; F04D 17/122
See application file for complete search history.

(56) References Cited

U.S. PATENT DOCUMENTS 4,063,846 A 12/1977 Eagle
5,133,639 A 7/1992 Gay et al.
5,256,033 A 10/1993 Kajiwara
5,318,403 A 6/1994 Kajiwara et al.
5,369,972 A 12/1994 Kajiwara et al.
6,439,835 B1 8/2002 Chien et al.
6,481,961 B1 11/2002 Pai
6,899,517 B2 5/2005 Gay et al.
7,290,984 B2 11/2007 Volk
7,632,065 B2 12/2009 Kawabata et al.
7,648,337 B2 1/2010 Kuroiwa et al.
8,043,051 B2 10/2011 Brunner
8,066,477 B2 11/2011 Markovitch
8,556,580 B2 10/2013 Stair et al.
2005/0147505 A1* 7/2005 Kuroiwa ..... F04D 1/063 417/247
2008/0292454 A1 11/2008 Brunner
2010/0008768 A1* 1/2010 Vedsted ..... F04D 7/04 415/173.1
2012/0020777 A1 1/2012 Eslinger

* cited by examiner

SUBMERSIBLE PUMP THRUST SURFACE ARRANGEMENT

CROSS-REFERENCE TO RELATED APPLICATION

This application claims the benefit under Title 35, U.S.C. § 119(e) of U.S. Provisional Patent Application Ser. No. 62/120,013, filed Feb. 24, 2015 and entitled SUBMERSIBLE PUMP THRUST SURFACE ARRANGEMENT, the entire disclosure of which is hereby expressly incorporated by reference herein.

BACKGROUND

1. Technical Field

The present disclosure relates to pumps and, in particular, to multistage submersible pumps.

2. Description of the Related Art

Submersible pumps are commonly used to pump water out of various well configurations, such as basement sumps or any other contained body of water. Submersible pumps may be formed as multistage pumps including several impellers which work in series to develop pressure within the pump. Water or another pumpable fluid is drawn into a pump inlet, commonly located near the bottom of the pump body, and discharged from a pump outlet after becoming pressurized by the pump impellers.

In multistage pump designs, multiple impellers are used in series with one impeller per pump stage. The impeller of the first stage draws fluid into the inlet and pressurizes the fluid, discharging the fluid to the next pump stage. Each respective downstream pump stage adds pressure from the previous stage and discharges the elevated-pressure fluid to the next neighboring stage. Accordingly, as the number of stages in a pump is increased, the total outlet pressure of the pump also increases.

In order to promote pump efficiency, recirculation of water from a downstream stage back to an upstream stage is generally sought to be minimized. In some designs, such recirculation is prevented by providing fluid seals between respective stages in appropriate positions and configurations. For example, fluid tight sealing between the rotating impeller of a pump stage and the adjacent nonrotating components (e.g., the pump diffuser and pump stage housing) has been a focus of previous designs.

U.S. Pat. No. 7,290,984 describes a multistage submersible pump in which an impeller includes a wear surface which wears down during service of the pump. When this wear surface wears down sufficiently, a sealing face of the impeller engages a washer to form a new, secondary seal.

SUMMARY

The present disclosure provides a multistage submersible pump including a sealing arrangement operable to inhibit upstream fluid recirculation, while also having a reduced or eliminated wear-in procedure. A wear-in bearing surface erodes during an initial, wear-in procedure of the pump, and a low-friction service bearing surface slowly engages as the wear-in procedure is completed. Both the wear-in and service bearing surfaces are integrated into a single, stamped stainless steel housing component, such that axial tolerance between the two surfaces is tightly controllable. The pump impeller provides corresponding wear-in and service bearing elements formed as part of a single monolithic component, thereby also offering tight axial tolerance control for the bearing elements which engage the bearing surfaces of the cup component. During initial operation of the pump, only a small portion of the wear-in bearing element is required to wear down to allow engagement of the service bearing element, thereby minimizing the required time to achieve optimal pump performance and enabling the use of a wide range of materials for the pump impeller.

In one form thereof, the present disclosure provides a submersible pump including: a monolithic metal housing component comprising a wear-in bearing surface at a first axial position and a service bearing surface at a second axial position axially spaced from the first axial position by a surface separation distance; an impeller rotatably assemblable with the housing component and having a plurality of impeller fluid channels operable to accelerate fluid radially outwardly, the impeller having a wear-in bearing element at a third axial position and a service bearing element at a fourth axial position spaced from the third axial position by a bearing separation distance; and a diffuser mountable to the housing component to define a pump stage cavity sized to contain the impeller, the diffuser having a plurality of diffuser fluid channels operable to transfer fluid radially inwardly, the bearing separation distance of the impeller larger than the surface separation distance of the housing component, such that when the impeller is rotatably received within the pump stage cavity and the wear-in bearing element abuts the wear-in bearing surface, a gap exists between the service bearing element and an adjacent sealing surface.

In another form thereof, the present disclosure provides a method of making components of a submersible pump, the method including: stamping a monolithic metal housing component such that the housing component has a base wall with a wear-in bearing surface at a first axial position and a service bearing surface at a second axial position axially spaced from the first axial position by a surface separation distance; producing an impeller such that the impeller is rotatably assemblable with the housing component, the step of producing the impeller including: forming a plurality of impeller fluid channels in the impeller that are operable to accelerate fluid radially outwardly; forming a wear-in bearing element at a third axial position; and forming a service bearing element at a fourth axial position spaced from the third axial position by a bearing separation distance, such that the bearing separation distance of the impeller larger than the surface separation distance of the housing component; and producing a diffuser such that the diffuser is mountable to the housing component to define a pump stage cavity sized to contain the impeller, the diffuser having a plurality of diffuser fluid channels operable to transfer fluid radially inwardly.

BRIEF DESCRIPTION OF THE DRAWINGS

The above-mentioned and other features of the disclosure, and the manner of attaining them, will become more apparent and will be better understood by reference to the following description of an embodiment of the disclosure taken in conjunction with the accompanying drawings, wherein.

Corresponding reference characters indicate corresponding parts throughout the several views. The exemplification set out herein illustrates an embodiment of the disclosure and such exemplification is not to be construed as limiting the scope of the invention in any manner.

DETAILED DESCRIPTION

Figure 1:
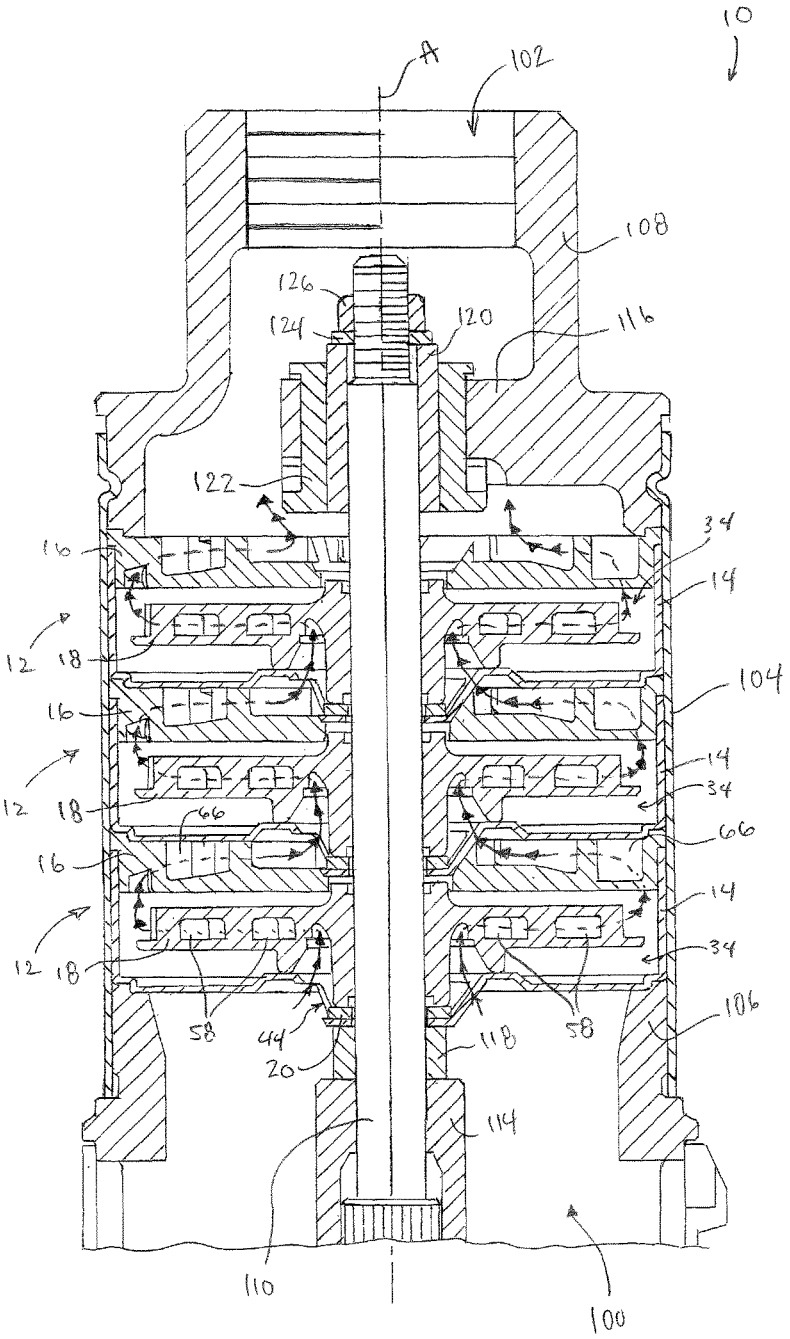
FIG. 1 is an elevation, cross-section view of a multistage submersible pump made in accordance with the present disclosure.

The present disclosure provides a multistage, submersible floating-impeller pump 10, shown in FIG. 1, in which the components of each individual pump stage 12 provide for reduction or elimination of the time required for a wear-in procedure, as well as streamlined and less-expensive part production through enhanced dimensional control of interacting part surfaces. In particular and as further described below, each pump stage 12 includes housing component 14 defining a cylindrical "cup shape" in the illustrated embodiment, which includes both a wear-in bearing surface 22 (FIG. 2) and service bearing surface 24. As illustrated, both of surfaces 22, 24 are included in a single, monolithically formed component 14 to more tightly control the axial spacing between surfaces 22, 24. During a wear-in procedure described in further detail below, this precise axial positioning of bearing surfaces 22, 24 reduces the required amount of frictional erosion of the impeller material to transition from the wear-in phase to regular pump operation.

Referring to FIG. 1, submersible pump 10 includes inlet 100 and outlet 102 with a plurality of pump stage assemblies 12 disposed therebetween. In the illustrated embodiment, three pump stages are illustrated, though it is contemplated that any number of pump stages may be used as required or desired for a particular application, including as few as one pump stage and, in some applications, up to 75 pump stages for high pressure applications. Each pump stage 12 is received within pump housing 104 and axially constrained at inlet 100 by inlet endcap 106, and at outlet 102 by outlet endcap 108. Drive shaft 110 is rotatably fixed to each of pump stages 12, as further described below, such that a motor (not shown) is operable to power drive shaft 110 and thereby activate the pumping action of submersible pump 10.

In the illustrated embodiment, drive shaft 110 is radially constrained at the inlet end of pump 10 by bushing 114. Spacer bushing 118 may be provided between bushing 114 and the lower axial end of the first pump stage 12 to provide a low-friction interface. At the outlet end of pump 10, drive shaft 110 is radially constrained by armature 116, which is formed as a part of outlet end cap 108 as illustrated. A second bushing 120 is affixed to drive shaft 110 via nut 126 and washer 124, and bearing 122 is disposed between bushing 120 and armature 116 to facilitate low-friction drive shaft rotation relative to end cap 108.

In the illustrated embodiment of FIG. 1, submersible pump 10 is activated by submerging at least inlet 100 in a fluid to be pumped, and typically flooding the internal cavities 34 of each stage 12. Drive shaft 110 is then activated to draw fluid into the first pump stage 12 from inlet 100 as impeller 18 of pump stage 12 accelerates fluid outwardly and upwardly. This accelerated, higher-pressure fluid travels downstream to diffuser 16, which distributes the pressurized fluid to the next downstream neighboring pump stage 12 for further acceleration by the second impeller 18. The second diffuser 16 then distributes the further pressurized fluid to the third pump stage 12, where it is accelerated still further prior to discharge at outlet 102.

Further general principles of operation for a multistage submersible pump which may be applicable to a design made in accordance with the present disclosure can be found in U.S. Pat. No. 7,290,984, the entire disclosure of which is hereby incorporated by reference herein.

Figure 2:
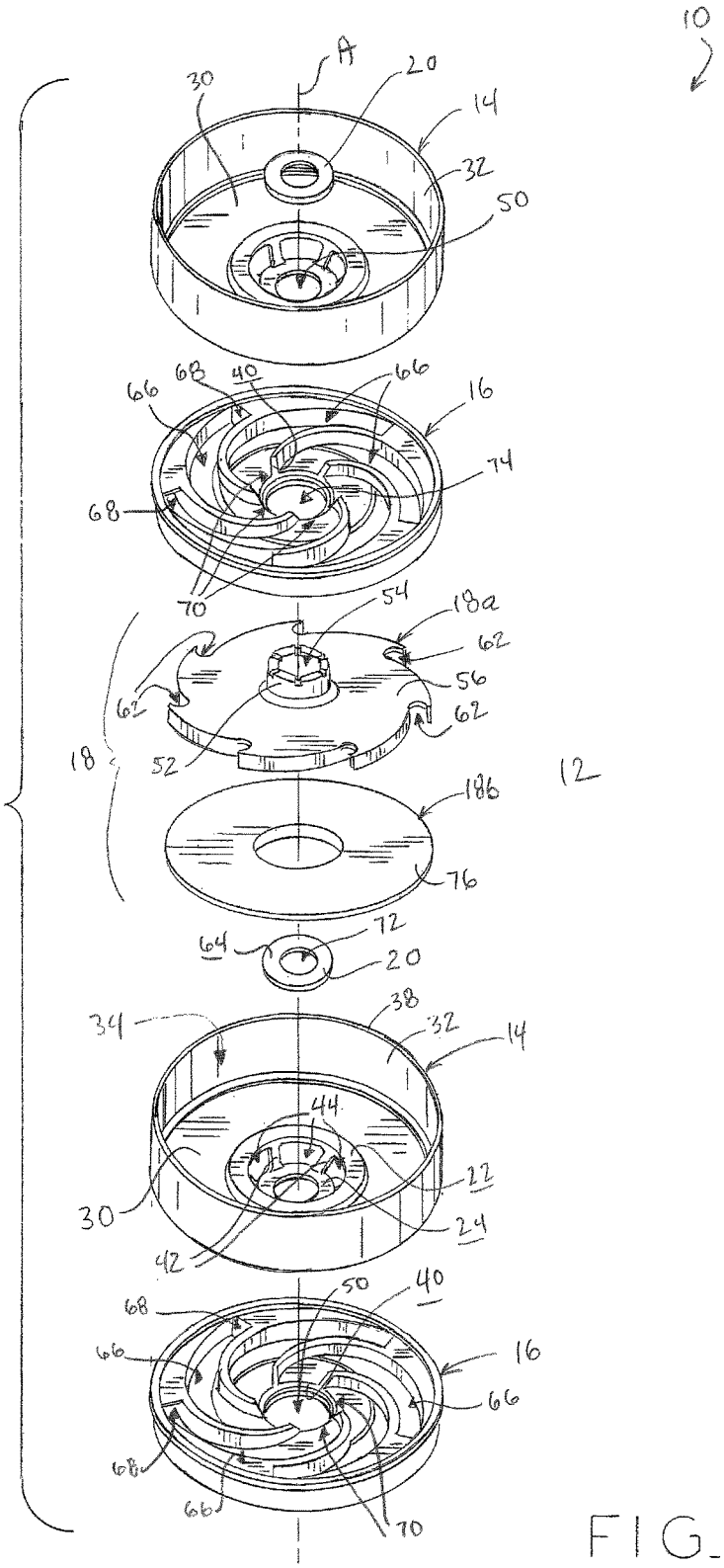
FIG. 2 is a perspective, exploded view of a portion of the multistage submersible pump shown in FIG. 1, including all the components of an intermediate stage and selected components of neighboring upstream and downstream stages.

Turning now to FIG. 2, an exploded view of an intermediate pump stage 12 is shown together with adjacent components of upstream and downstream pump stages also illustrated for reference. For purposes of the present disclosure, "upstream" structures and components are those considered to be closer to inlet 100 relative to a chosen reference point, while "downstream" structures and components are closer to outlet 102 relative to a chosen reference point. In addition, upstream structures and components may be considered to be "below" downstream structures and components in the context of submersible pump 10 as illustrated, because inlet 100 is typically located at the bottom of submersible pump 10, and fluid is therefore pumped upwardly toward outlet 102.

Housing component 14 may be the upstream (i.e., bottom) component of each pump stage 12, as illustrated. Housing component 14 includes wear-in and service bearing surfaces 22, 24 as discussed further below, both of which are integrally and monolithically formed from a single piece of metal material. A substantially planar and circular base wall 30 extends radially outwardly from surfaces 22, 24, and cylindrical shell wall 32 extends upwardly from the outer edge of base wall 30 to define an open-ended cavity 34. In this way, housing component 14 is a generally cup shaped component.

Figure 5:
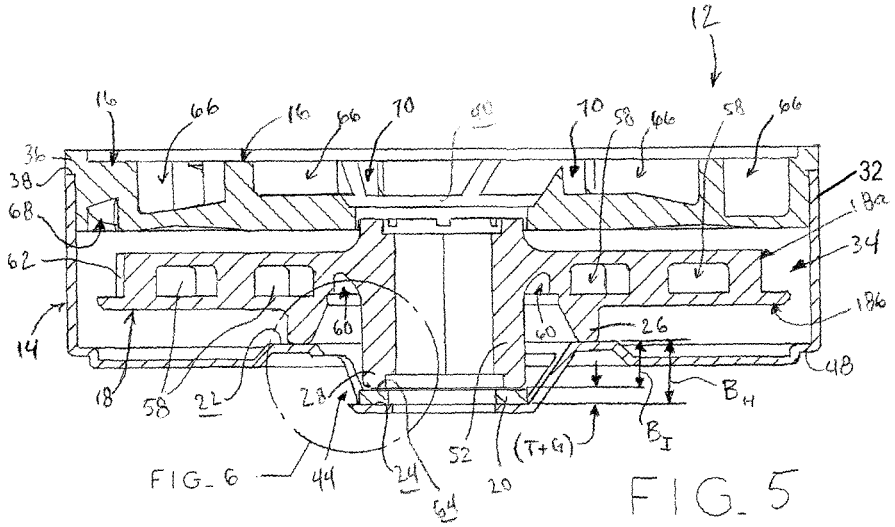
FIG. 5 is an elevation, cross-section view of a single pump stage of the submersible pump shown in FIG. 1.

As best seen in FIG. 5, impeller 18 is received within cavity 34, and diffuser 16 acts as a cap mounted to the upper axial edge of cylindrical wall 32 to substantially enclose cavity 34 with impeller 18 therein. In an exemplary embodiment, washer 20 may also be received within cavity 34, and disposed between service bearing surface 24 and impeller assembly 18 as further described below.

Figure 4:
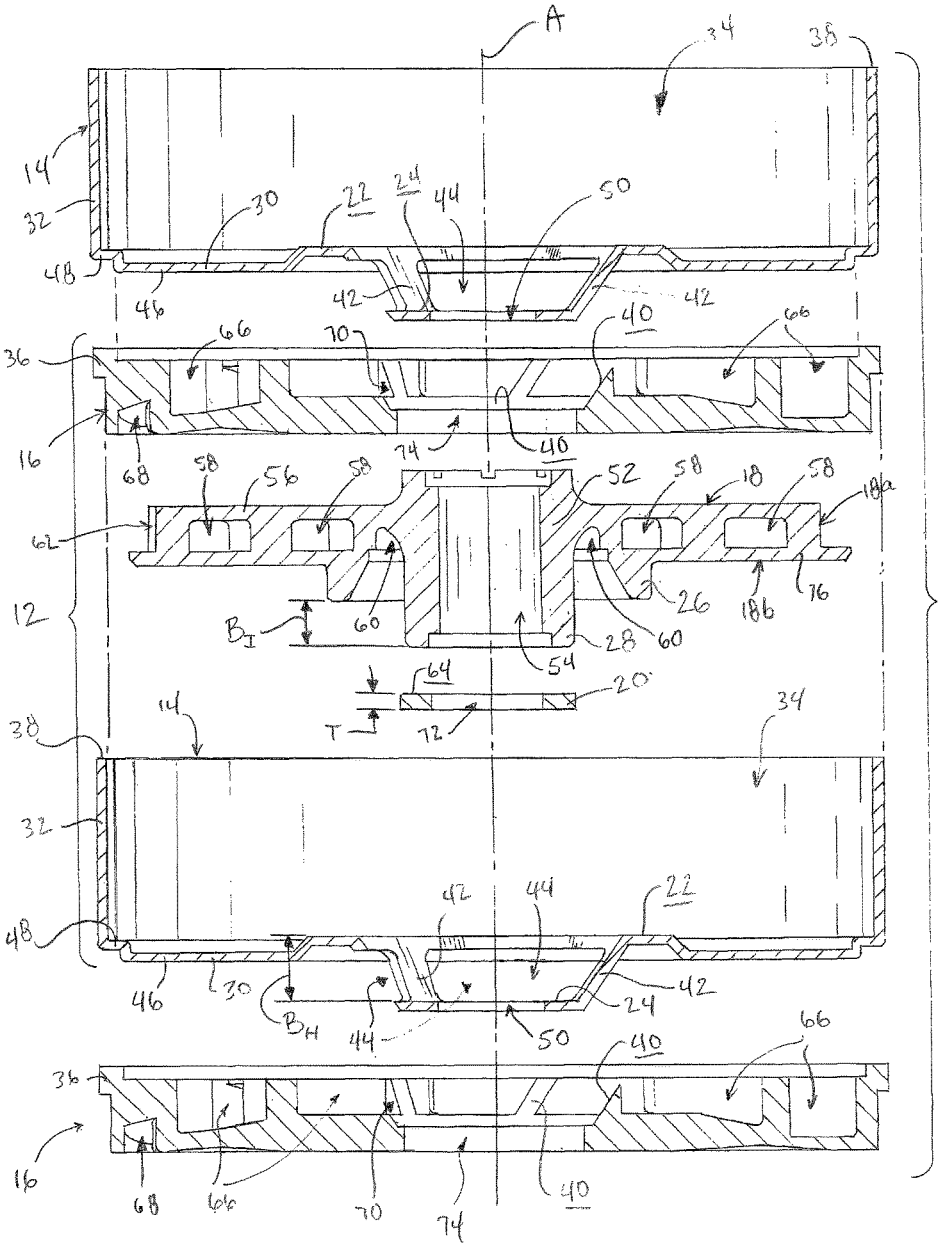
FIG. 4 is a cross-section, elevation view of the exploded view shown in FIG. 2.
Figure 6:
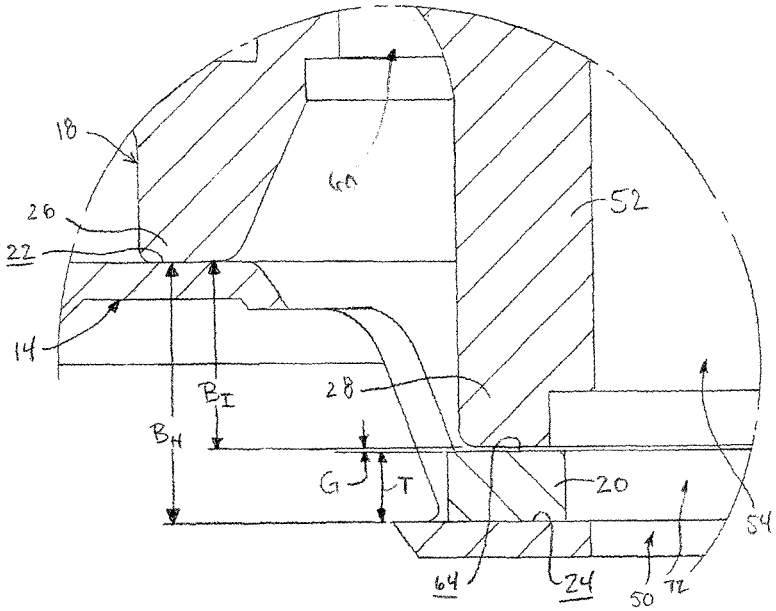
FIG. 6 is an enlarged, partial cross-section view of a portion of the pump stage shown in FIG. 5, illustrating wear-in and service bearing surfaces and bearing elements.

Upon assembly, as best shown by a comparison of FIGS. 4 and 5, washer 20 is placed into cavity 34 of housing component 14 and into abutment with service bearing surface 24. Impeller assembly 18 is then lowered into cavity 34 until wear-in bearing element 26 comes into abutting contact with wear-in bearing surface 22. At this point, washer 20 is captured between service bearing element 28 and service bearing surface 24, though a small gap G is formed therebetween, as shown in FIG. 6 and described in further detail below. Drive shaft aperture 72 is provided through the center of washer 20, and is sized to receive drive shaft 110 therethrough.

Diffuser 16 is then lowered into engagement with housing component 14 until shoulder 36 of diffuser 16 abuts upper edge 38 of shell wall 32 of housing component 14. In particular, at the radially outward end of circular wall 46, a step 48 forms an annular recess around the bottom surface of housing component 14 that is sized to receive an abutting upper portion of shoulder 36 to mate respective pump stages 12 to one another. Drive shaft aperture 74 is provided through the center of diffuser 16 adjacent outlet 70, as shown in FIG. 4, and is sized to receive drive shaft 110 therethrough. In an exemplary embodiment, diffuser 16 is a molded polymer component, which may be made by, e.g., injection molding in order to efficiently impart the complex structure of diffuser fluid channels 66 and other features to the part. With diffuser 16 mounted to housing component 14 as shown in FIG. 5, pump stage 12 is fully assembled and ready for integration into the larger pump 10 (FIG. 1).

Additional pump stages 12 may be similarly assembled to create individual pump stage units that can be assembled to one another as shown in FIG. 1. To this end, diffuser 16 includes an interstage seating surface 40 defining a generally conical profile that is sized and configured to engage the correspondingly conical outer surface of webs 42 (FIG. 4) extending axially and radially between service bearing surface 24 and wear-in bearing surface 22. When respective pump stages 12 are assembled to one another as shown in FIG. 4, the webs 42 engage and seat against interstage seating surface 40 to provide a secure centered orientation. This in turn promotes coaxiality of the respective pump stages 12 upon assembly.

As best seen in FIG. 2, intersurface webs 42 define pump stage inlet apertures 44 therebetween to admit incoming fluid to each pump stage 12. Webs 42 are spaced apart from one another and radially arranged to correspond with respective outlets 70 of diffuser fluid channels 66 in the neighboring upstream stage, such that fluid flowing through diffuser channels 66 is admitted to the next downstream stage via apertures 44.

Turning now to FIG. 4, the illustrated cross-section of housing component 14 illustrates various geometric characteristics thereof. In the exemplary illustrated embodiment, base wall 30 is shown as a stamped metal piece including the generally planar and circular bottom wall 46, wear-in bearing surface 22, webs 42 and service bearing surface 24. Step 48, which interfits with shoulder 36 of diffuser 16 upon assembly of pump stages 12 to one another as noted above, may also be part of the features formed by stamping of housing component 14. Drive shaft aperture 50 is formed in the portion of base wall 30 including service bearing surface 24, and is sized to admit passage of drive shaft 110 (FIG. 1) therethrough. As illustrated, bearing surface 22 is upwardly axially spaced from the upper side of circular wall 46. Webs 42 extend radially inwardly and downwardly from the radial inward end of wear-in bearing surface 22, ending at service bearing surface 24 which is axially downwardly spaced from the lower surface of bottom wall 46. Thus, wear-in bearing surface 22 and service bearing surface 24 are disposed at opposite sides of circular wall 46.

In the illustrated embodiment in which housing component 14 is a cup-shaped member, shell wall 32 may be separately formed from a strip of bent material with its ends fused to create generally cylindrical construct. A lower edge of this cylindrical construct may then be welded to the radial outward edge of base wall 30 (e.g., to step 48 in the illustrated embodiment). When so welded, shell wall 32 and base wall 30 form a single, monolithic cup-shaped housing component 14. However, it is contemplated that the monolithically formed housing component 14 may omit shell wall 32. For example, shell wall 32 may instead be formed as a part of diffuser 16 which extends radially downwardly to mate with the radial outward edge of base wall 30 upon assembly. Yet another option is to provide shell wall 32 as a separate component which is not monolithically formed as a portion of housing component 14 but, rather, as a separate component assembled to base wall 30 and diffuser 16. Moreover, the monolithic, integrally formed housing component 14 may include only wear-in and service bearing surfaces 22, 24 and their joining structure, i.e., webs 42, while still providing the shortened or eliminated wear-in functionality of pump 10 as further described below.

Referring still to FIG. 4, wear-in and bearing surfaces 22, 24 are axially spaced from one another by a surface separation distance $B_H$. In the illustrated embodiment, surfaces 22, 24 each define planes which are substantially parallel to one another and substantially perpendicular to longitudinal axis A of pump stage 12, which is also the longitudinal axis of submersible pump 10 (FIG. 2). Because base wall 30 is monolithically formed from a single piece of metal material, such as by a metal stamping process, surface separation distance $B_H$ can be efficiently and precisely controlled to define a nominal value within a tight tolerance range without any further machining of the respective bearing surfaces 22, 24 after the stamping process. In the context of the exemplary housing component 14 shown and described herein, "machining" is the use of machine tools to selectively remove material from a surface, such as bearing surfaces 22 or 24, in order to control its relative size or location. As noted above and described further herein, housing component 14 is formed by stamping, which may include punching, blanking, embossing, bending, flanging and coining, for example, as well as other processes which cause cold flow of sheet material in a tool and die to impart a desired shape.

In one exemplary embodiment, submersible pump 10 is a "four inch" pump design, i.e., the overall diameter of pump stage cavity 34 is approximately four inches. For such a four-inch pump, a chosen nominal value for distance $B_H$ may be manufactured in a single stamping process to within ±0.003 inches. As further described below, the tight tolerance control of surface separation distance $B_H$ facilitates a reduced or eliminated break-in period for submersible pump 10.

Figure 3:
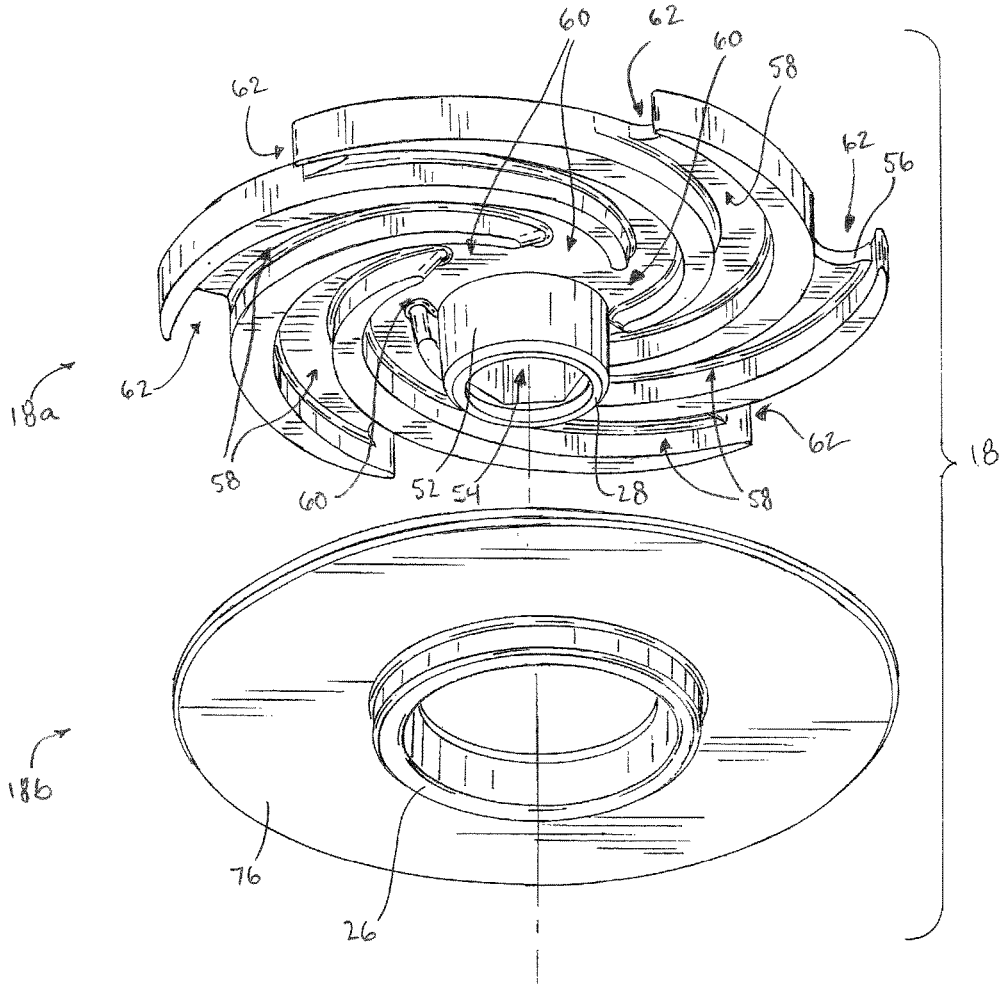
FIG. 3 is another perspective, exploded view of the impeller of the pump stage shown in FIG. 2, illustrating bearing surfaces and fluid acceleration channels thereof.

Turning now to FIG. 3, impeller assembly 18 may be formed from two individual molded polymer pieces including impeller body 18*a* and impeller closure plate 18*b*. Impeller body 18*a* includes central boss 52 having a drive shaft aperture 54 formed therethrough. In the illustrative embodiment of FIG. 3, drive shaft aperture 54 is hex-shaped, in order to be rotatably fixed with the correspondingly hex-shaped drive shaft 110 for driving engagement therebetween. Baseplate 56 extends radially outwardly from an upper portion of central boss 52 and has a plurality of arcuate, spiral shaped impeller fluid channels 58 formed on an under surface of baseplate 56. Each impeller fluid channel 58 includes an inlet 60 at its radial inward end and an outlet 62 as its radially outward end.

Closure plate assembly 18*b* includes closure plate 76, which is a generally circular, substantially planar piece of polymer material capable of being welded to the walls of fluid channels 58 of impeller body 18*a*, such as by sonic welding. When so welded, as shown in FIG. 4, impeller body 18*a* and closure plate 18*b* experience material flow and fusing to become monolithically formed as a single piece. Closure plate 18*b* assembly also includes wear-in bearing element 26 formed as a flange extending downwardly from the lower surface of closure plate 76, as shown in FIG. 3. When closure plate 76 is assembled and welded to the walls forming fluid channels 58 of impeller 18*a* as illustrated, closure plate 76 at least partially covers each of impeller fluid channels 58 such that fluid flow therethrough is substantially constrained to radial flow from inlet 60 towards outlet 62. More particularly, when impeller 18 is assembled, inlet 60 is disposed between the radially outer surface of central boss 52 and the radially inner surface of the flange forming wear-in bearing element 26. In operation, fluid is drawn into fluid channels 58 at this location and accelerated radially outwardly toward the periphery of impeller assembly 18 and fluid outlet 62, as further described below.

A lower portion of central boss 52 forms service bearing element 28, a lower surface of which is sized and shaped to engage upper sealing surface 64 of phenolic washer 20. As shown in FIGS. 4-6 and further described below, this lower surface of service bearing element 28 is axially spaced from the lower sealing surface of wear-in bearing element 26 by bearing separation distance $B_I$. Because impeller assembly 18 is a monolithic part formed from two molded constructs which can be precisely welded to one another, the nominal value for bearing separation distance $B_I$ can be controlled within a tight tolerance. In the exemplary embodiment of a four inch submersible pump 10 described above, bearing separation distance $B_I$ can be controlled within ±0.004 inches in an as-molded, as-welded state (i.e., without surface machining subsequent to part formation). As further described below, this tight tolerance cooperates with the correspondingly tight tolerance of surface separation distance $B_H$ of housing component 14 to facilitate a reduced or eliminated wear-in procedure for submersible pump 10.

Turning now to FIG. 5, upon assembly, pump stage 12 has impeller assembly 18 received within cavity 34 of the cup-shaped housing component 14 and is partially enclosed by diffuser 16 mounted to the top of housing component 14. In this configuration, pump stage 12 is ready to begin a wear-in procedure as further described below. After assembly of pump stage 12 but before the wear-in procedure begins, wear-in bearing element 26 rests upon wear-in bearing surface 22 of housing component 14. As shown in FIG. 6, service bearing element 28 is slightly spaced away from upper sealing surface 64 of washer 20, which rests upon service bearing surface 24. This slight spacing defines gap G between upper sealing surface 64 and the adjacent lower surface of service bearing element 28. Gap G is a function of the difference between surface separation distance $B_H$ between wear-in and service bearing surfaces 22, 24, and bearing separation distance $B_I$ between the respective lower surfaces of wear-in and service bearing elements 26, 28. Subtracting the axial thickness T of phenolic washer 20 from this difference yields gap G. That is, $(B_H-B_I)-T=G$. As noted above, surface separation distance $B_H$ can be controlled to within plus or minus 0.003 inches using a stamping process for the metal material of base wall 30, and with no further machining of housing component 14. As noted above, the tolerance for bearing separation distance $B_I$ can be maintained at plus or minus 0.004 inches in an as-molded, welded configuration (also with no further machining). In addition, phenolic washer 20 can be produced with a thickness T having a tolerance of plus or minus 0.003 inches.

Thus, in the limiting case, gap G is maximized when surface separation distance $B_H$ is its maximum nominal value within its tolerance range, and bearing separation distance $B_I$ and thickness T are both at their minimum nominal values within their respective tolerance ranges. In this situation, the nominal design value for gap G, e.g., 0.006 inches as described below, would be expanded by up to 0.010 inches to 0.016 inches. Conversely, gap G is minimized when surface separation distance $B_H$ is a minimum nominal value within its tolerance range, and bearing separation distance $B_I$ and thickness T are maximum nominal values within their respective tolerance ranges. In this instance, the nominal design value for gap G is contracted by up to 0.010 inches to −0.004 inches, with negative values in the tolerance range for gap G indicating that gap G may be completely closed in the as-manufactured state of housing component 14 and impeller 18. The "negative values" of gap G signify complete closure of gap G, with the nominal negative value indicative of a gap formed between wear-in bearing surface 22 and wear-in bearing element 26. Thus, the nominal design values for gap G of as low as −0.004 inches signifies a maximum gap between wear-in bearing surface 22 and wear-in bearing element 26 of up to 0.004 inches.

In view of the foregoing, the nominal gap G may be set between 0.005 inches and 0.007 inches for any assembly of pump stage 12, such as 0.006 inches. Provided that each of the individual parts (housing component 14, diffuser 16 and impeller assembly 18) are within their design tolerances as described above, this tight range of values for gap G (together with the small nominal values of gap G) ensures that for a majority of pump stages, only a small amount of wear-in bearing element 26 must be frictionally eroded during the wear-in procedure for submersible pump 10 because gap G will be small. For a minority of pump stages, none of wear-in bearing element 26 must be frictionally eroded during the wear-in procedure because gap G will be negative. Overall, a multi-stage pump system 10 can be produced with a very rapid wear-in procedure using the design principles and constraints discussed herein.

Turning again to FIG. 1, submersible pump 10 is shown ready to use. Prior to activating drive shaft 110, inlet 100 and each of the pump stages 12 enclosed within pump housing 104 are typically submerged so that fluid is allowed to flood inlet 100 and each of the pump cavities 34. At this point, activation of drive shaft 110 causes impellers 18 to rotate within cavity 34, accelerating fluid outwardly through impeller fluid channels 58 as noted above. This acceleration draws further fluid into the initial, upstream pump stage 12 via pump stage inlet apertures 44, while discharging fluid to the first diffuser 16 of the upstream pump stage 12. The accelerated fluid enters diffuser 16 at inlet 68, where it travels through spiral shaped diffuser fluid channels 66 to respective outlets 70, where the fluid is discharged from the first pump stage 12 and admitted to the next neighboring downstream pump stage 12 via pump stage inlet apertures 44. Further fluid acceleration commences and the process of fluid pressurization through multiple stages continues in a similar fashion. Fluid progression through the three illustrated pump stages 12 is shown in FIG. 1 schematically.

The fluid pressure developed by rotation of impeller 18 creates a pressure differential between fluid inlet 60 of impeller fluid channel 58 and outlet 62 thereof. Thus, the fluid pressure within pump stage cavity 34 is greater than the fluid pressure at the inlet apertures 44 of that same pump stage 12. In order to prevent backflow or other fluid communication between these differential pressure areas (other than via fluid channels 58, as intended), a fluid-tight seal is created between wear-in bearing element 26 and the abutting wear-in bearing surface 22. In order to promote the formation and maintenance of this fluid type seal while avoiding undue friction during pump operation, a lubricious bearing interface is provided. In an exemplary embodiment, housing component 14 (and, therefore, wear-in bearing surface 22) may be made of stainless steel, while impeller assembly 18 (and, therefore, wear-in bearing element 26) may be made of a polymer material such as acetal, polypropylene or polycarbonate.

However, as noted above and shown in FIG. 6, a small gap G is formed between sealing surface 64 of phenolic washer 20 and the adjacent lower surface of service bearing element 28. Thus, during initial operation of submersible pump 10, a small amount of working fluid may flow radially inwardly from inlet apertures 44 toward drive shaft 110, and therefore outside the intended flow path through pump stage 12.

However, gap G is reduced to zero after the wear-in procedure, preventing any further "leakage" flow during the overall service life of pump 10. In particular, friction created between wear-in bearing element 26 and wear-in bearing surface 22 during initial operation of submersible pump 10 causes the bottom surface of bearing element 26 to abrade and slowly erode. As this erosion progresses, bearing separation distance $B_I$ slowly decreases, thereby decreasing and eventually eliminating gap G.

Concomitantly, service bearing element 28 slowly comes into contact with sealing surface 64 of washer 20. As this contact occurs, first lightly and then more firmly, the bottom surface of bearing element 28 and sealing surface 64 slowly reshape one another to create a fluid-tight, substantially planar-contact seal therebetween. This fluid-tight seal is firmly established as pump 10 reaches steady-state operation, at which point bearing element 28 and washer 20 rotate together along a low-friction interface formed between service bearing surface 24 and washer 20. In an exemplary embodiment, washer 20 is made of a carbon based material, such that a carbon/stainless steel bearing surface is created after the wear-in procedure is complete. Thus, service bearing element 28 and phenolic washer 20 will not significantly wear during operation of submersible pump 10, thereby establishing a long term seal which can be expected to continue working for the service life of the pump.

Meanwhile, the eroded wear-in bearing element 26 continues to form a fluid tight seal, but creates less frictional resistance to rotation of impeller 18 as service bearing element 28 takes up axial load and erosion of bearing element 26 ceases. The power required to operate the various stages 12 of submersible pump 10 reduces after the wear-in procedure, as no further energy is required for erosion of wear-in bearing 26 and low-friction rotation commences. In addition, pump 10 operates more efficiently because interstage sealing is more complete after gap G is eliminated. In particular, high-pressure fluid arriving from a previous pump stage 12 is channeled solely into inlets 60 of impeller fluid channels 58, as fluid-tight seals are provided at the radially inward side of inlets 60 (by service bearing element 28 and service bearing surface 24) and at the radially inward side of inlets 60 (by wear-in bearing 26 and wear-in bearing surface 22).

Because gap G is minimized upon initial manufacture of each submersible pump stage 12, the wear-in procedure may also be minimized because the amount of erosion required of wear-in bearing 26 is minimized. In an exemplary embodiment using a four inch pump with a stainless steel housing component 14 and silicon impeller 18, the wear-in procedure may be shortened to a matter of hours. Moreover, the tight tolerance, low- or zero-wear-in design of the present disclosure facilitates the use of alternative materials for impeller 18 which may be less lubricious, less expensive and/or harder than materials used in previous designs. Examples of alternative materials uniquely suited to an impeller used in the pump of the present disclosure include modified polyphenylene ether (PPE) and polyphenylene sulfide (PPS) resins, such as the family of materials sold under the NORYL brand available from Sabic Global Technologies B.V. of the Netherlands. In designs where the total tolerance for gap G is maintained at plus-or-minus 0.002 inches, metal materials may be used for impeller 18.

In some instances, tolerances may be controlled tightly enough to substantially or entirely eliminate the wear-in procedure by ensuring a light contact between service bearing element 28 and washer 20 immediately upon initial operation of submersible pump 10. That is, a very tight tolerance may enable the impeller 18 and housing 14 contact one another with a desired level of pressure at service bearing element 28 upon initial pump startup. In this instance, a small gap between wear-in surface 22 and wear-in bearing element 26 may be present upon initial startup.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A submersible pump including:

a monolithic metal housing component defining a longitudinal axis, the housing component comprising:

a wear-in bearing surface facing a first axial direction and disposed at a first axial position along the longitudinal axis; and a service bearing surface facing the first axial direction and disposed at a second axial position along the longitudinal axis, the second axial position axially spaced from the first axial position by a surface separation distance;

an impeller rotatably assemblable with the housing component and having a plurality of impeller fluid channels operable to accelerate fluid radially outwardly, the impeller including:

a wear-in bearing element at a third axial position; and a service bearing element at a fourth axial position spaced from the third axial position by a bearing separation distance, the wear-in bearing element radially aligned with the wear-in bearing surface and facing a second axial direction upon assembly with the housing component, the first and second axial directions mutually opposed such that the wear-in bearing element is positioned to bear upon the wear-in bearing surface, the service bearing element radially aligned with the service bearing surface and facing the second axial direction upon assembly with the housing component such that the service bearing element is positioned to bear upon the service bearing surface; and a diffuser mountable to the housing component to define a pump stage cavity sized to contain the impeller, the diffuser having a plurality of diffuser fluid channels operable to transfer fluid radially inwardly, the bearing separation distance of the impeller larger than the surface separation distance of the housing component, such that when the impeller is rotatably received within the pump stage cavity and the wear-in bearing element abuts the wear-in bearing surface, a gap exists between the service bearing element and an adjacent sealing surface.

2. The submersible pump of claim 1, wherein:

the monolithic metal housing component includes a generally circular base wall extending radially outwardly from the wear-in and service bearing surfaces; and the wear-in bearing surface is axially spaced in the first axial direction from a first side of the base wall; and the service bearing surface is axially spaced in the second axial direction from a second, opposing side of the base wall.

3. The submersible pump of claim 2, wherein the housing component includes a generally cylindrical wall extending from the base wall, such that the housing component is generally cup-shaped.

4. The submersible pump of claim 3, wherein the diffuser is sized to interfit with an upper edge of the generally cylindrical wall of the housing component to define the pump stage cavity.

5. The submersible pump of claim 1, further comprising a washer positionable between the service bearing surface of the housing component and the service bearing element of the impeller, the washer including the sealing surface.

6. The submersible pump of claim 5, wherein the washer comprises a phenolic washer.

7. The submersible pump of claim 1, wherein the gap between the sealing surface and the service bearing element is no more than 0.007 inches upon assembly of the impeller to the housing component in an as-manufactured, non-machined state.

8. The submersible pump of claim 1, wherein the housing component is made of stamped stainless steel.

9. The submersible pump of claim 1, wherein:

a plurality of webs extend between the wear-in and service bearing surfaces of the housing component and are monolithically formed with the housing component; and at least one inlet aperture is formed between the plurality of webs.

10. The submersible pump of claim 9, wherein:

the housing component, the impeller and the diffuser are assembled to form a pump stage;

the submersible pump includes a plurality of the pump stages; and the plurality of diffuser fluid channels are alignable with the at least one inlet aperture, such that fluid flowing from an upstream pump stage can be admitted into a downstream pump stage via the at least one inlet aperture.

11. The submersible pump of claim 1, wherein:

the housing component, the impeller and the diffuser are assembled to form a pump stage; and the submersible pump includes a plurality of the pump stages.

12. The submersible pump of claim 11, wherein:

the housing component includes a plurality of pump stage inlet apertures formed between the wear-in and service bearing surfaces; and the apertures are radially aligned with respective outlets of the plurality of diffuser fluid channels such that fluid can flow from an upstream pump stage to a downstream pump stage via the apertures.

13. The submersible pump of claim 1, wherein the impeller comprises an impeller assembly comprising:

an impeller body having the plurality of impeller fluid channels formed therein; and an impeller closure plate at least partially covering the plurality of impeller fluid channels, such that fluid is substantially constrained to radial flow from an impeller inlet near an axis of impeller rotation toward an impeller outlet near a periphery of the impeller assembly.

14. The submersible pump of claim 13, wherein:

the impeller body comprises a central boss with a lower axial end defining the service bearing element; and the impeller closure plate comprises a flange radially spaced from the central boss and extending downwardly from a lower surface of the impeller, the flange having a lower axial end defining the wear-in bearing element.

15. The submersible pump of claim 14, wherein at least one impeller inlet is disposed between the central boss and the flange.

16. The submersible pump of claim 1, wherein the impeller is a monolithic, non-metal material.

17. A method of making components of a submersible pump, the method including:

stamping a monolithic metal housing component such that the housing component has a base wall with a wear-in bearing surface at a first axial position and a service bearing surface at a second axial position axially spaced from the first axial position by a surface separation distance, the wear-in bearing surface and the service bearing surface both facing in a first axial direction with respect to a longitudinal axis of the metal housing component;

producing an impeller such that the impeller is rotatably assemblable with the component, the step of producing the impeller including:

forming a plurality of impeller fluid channels in the impeller that are operable to accelerate fluid radially outwardly;

forming a wear-in bearing element at a third axial position, the wear-in bearing element radially aligned with the wear-in bearing surface and facing in a second axial direction upon assembly, the first and second axial directions mutually opposed such that the wear-in bearing element is positioned to bear upon the wear-in bearing surface; and forming a service bearing element at a fourth axial position, the service bearing element radially aligned with the service bearing surface and facing the second axial direction upon assembly such that the service bearing element is positioned to hear upon the service bearing surface, the fourth axial position spaced from the third axial position by a bearing separation distance, such that the bearing separation distance of the impeller is larger than the surface separation distance of the housing component; and producing a diffuser such that the diffuser is mountable to the housing component to define a pump stage cavity sized to contain the impeller, the diffuser having a plurality of diffuser fluid channels operable to transfer fluid radially inwardly.

18. The method of claim 17, further comprising assembling the impeller to the housing component with a washer between the service bearing surface and the service bearing element, such that the wear-in bearing element abuts the wear-in bearing surface and a gap exists between the washer and one of the service bearing element and the service bearing surface.

19. The method of claim 18, wherein the gap is no more than 0.007 inches upon assembly of the impeller to the housing component in an as-manufactured, non-machined state.

20. The method of claim 18, further comprising rotating the impeller to cause frictional erosion of the wear-in bearing element until the gap is reduced to substantially zero.

21. The method of claim 17, wherein the step of stamping the monolithic metal housing component comprises:

forming the wear-in bearing surface at a first side of a circular base wall extending radially outwardly from the wear-in and service bearing surfaces; and forming the service bearing surface at a second, opposing side of the circular base wall.

22. The method of claim 21, further comprising welding a substantially cylindrical shell wall to an outer periphery of the base wall to form the housing component into a cup-shaped part.

23. The method of claim 17, further comprising:

repeating the steps of stamping a monolithic metal housing component, producing an impeller and producing a diffuser to produce components for a plurality of pump stages;

assembling respective housing components, impellers and diffusers into the plurality of pump stages; and assembling the plurality of pump stages to one another for use in a multistage submersible pump.

24. The method of claim 17, wherein the step of producing the impeller comprises molding the impeller from a non-metal material to create a monolithic non-metal impeller.

25. The method of claim 24, wherein the step of molding the monolithic non-metal impeller comprises:

molding an impeller body to include a central boss with a lower axial end defining the service bearing element, a fluid channel baseplate and the plurality of impeller fluid channels; and molding an impeller closure plate to include a fluid channel closure plate and a flange extending axially from a lower surface of the fluid channel closure plate, the flange having a lower axial end defining the wear-in bearing element; and attaching the impeller body to the impeller closure plate to form the monolithic non-metal impeller, such that the flange is radially spaced from the central boss.

26. The method of claim 25, wherein the step of attaching comprises sonic welding the impeller body to the impeller closure plate.

27. The method of claim 17, wherein the step of producing the diffuser comprises molding the diffuser from a non-metal material.

28. A submersible pump comprising:

a monolithic metal housing component through which a longitudinal axis extends, the housing component including:

a wear-in bearing surface facing a first axial direction and disposed at a first axial position along the longitudinal axis; and a service bearing surface facing the first axial direction and disposed at a second axial position along the longitudinal axis, the second axial position axially spaced from the first axial position by a surface separation distance;

an impeller rotatably assembled with the housing component, the impeller including:

a wear-in bearing element facing a second axial direction and disposed at a third axial position along the longitudinal axis; and a service bearing element facing the second axial direction and disposed at a fourth axial position along the longitudinal axis, the fourth axial position axially spaced from the third axial position by a bearing separation distance, the wear-in bearing element radially aligned with and axially facing the wear-in bearing surface at a first radial position relative the longitudinal axis, the service bearing element radially aligned with and axially facing the service bearing surface at a second radial position spaced radially from the first radial position, the bearing separation distance being larger than the surface separation distance, such that the wear-in bearing element abuts the wear-in bearing surface and the service bearing element is axially spaced from the service bearing surface.

29. The submersible pump of claim 28, wherein the impeller includes a plurality of impeller fluid channels operable to accelerate fluid radially outwardly, the assembly further comprising:

a diffuser mountable to the housing component to define a pump stage cavity sized to contain the impeller, the diffuser having a plurality of diffuser fluid channels operable to transfer fluid radially inwardly.

30. The submersible pump of claim 28, further comprising:

a drive shaft rotatably fixed to the impeller; and a motor operable to power the drive shaft.

* * * * *